US005714221A

United States Patent [19]

Sugibuchi

[11] Patent Number: 5,714,221

[45] Date of Patent: Feb. 3, 1998

[54] TRANSFERABLE COVER-UP ARTICLES

[75] Inventor: Takashi Sugibuchi, Kanagawa pref., Japan

[73] Assignee: Minnesota Mining and Manufacturing Company, St. Paul, Minn.

[21] Appl. No.: 660,270

[22] Filed: Jun. 7, 1996

[30] Foreign Application Priority Data

Jun. 21, 1995 [JP] Japan ..... 7-154847

[51] Int. Cl.[6] ..... B42D 15/00

[52] U.S. Cl. ..... 428/40.1; 281/83; 428/41.7; 428/41.8; 428/41.9; 428/42.1; 428/42.2; 428/42.3; 428/201; 428/203; 428/212; 428/914

[58] Field of Search ..... 428/40.1, 41.8, 428/41.7, 41.9, 42.1, 42.2, 42.3, 212, 201, 203, 914; 283/81

[56] References Cited

U.S. PATENT DOCUMENTS

| | | | |
|---|---|---|---|
| 3,898,357 | 8/1975 | Miller | 428/42.3 |
| 3,942,621 | 3/1976 | Karlan | 197/181 |
| 4,090,464 | 5/1978 | Bishopp | 428/42.1 |
| 4,676,861 | 6/1987 | Bishop | 156/527 |
| 5,050,909 | 9/1991 | Mertens et al. | 283/81 |

FOREIGN PATENT DOCUMENTS

| | | | |
|---|---|---|---|
| 0 058 565 A2 | 8/1982 | European Pat. Off. | C09D 9/00 |

*Primary Examiner*—Nasser Ahmad
*Attorney, Agent, or Firm*—Carolyn V. Peters

[57] ABSTRACT

To provide a transferable cover-up article which insures correct adhesion of the cover-up substrate to an adherend, has sufficient masking property and also enables removal of the cover-up substrate. The transferable cover-up article 10 of the present invention comprises a light-transmitting backing 11 and a cover-up substrate 12 laminated on the backing 11 through a removable adhesive 13, the substrate 12 is smaller than the backing 11 and a removable adhesive 13 is laminated on the surface of the substrate 12 not facing the backing 11.

8 Claims, 2 Drawing Sheets

TRANSFERABLE COVER-UP ARTICLES

TECHNICAL FIELD

The present invention relates to a transferable cover-up article comprising a backing having provided thereon a removable cover-up substrate, where only the cover-up substrate is transferable to an adherend.

BACKGROUND OF INVENTION

Transferable cover-up articles used for correcting a part of a document or deleting or covering a part of letters therein are already known.

For example, in the past, there were articles comprising a removable paper as the backing having laminated thereon a substrate having amasking property. In the case of this type of articles, a permanent adhesive was usually coated on the substrate surface to be put into contact with a removable paper. For transferring this substrate to an adherend, the substrate was peeled off from the removable paper and superposed and pressed on a predetermined adherend. The adhesion to the adherend required a precise positioning, however, it was in general very difficult to effect correct positioning while taking by a hand only a substantially adhesive substrate peeled off from the removable paper. In addition, it was impossible to peel off again the substrate bonded to the adherend with a permanent adhesive. The last inconvenience was overcome by using a removable adhesive but the difficulty in positioning was not able to be solved and therefore, upon repeated bonding, the adhesive used to be stained by the hand to undergo reduction in adhesion or to smudge the adherend. This type of articles is presently not used.

Transferable cover-up articles presently used are classified roughly into those of sheet type and tape type. Examples of sheet type articles are those sold by Carbon paper, under the tradename of "Union Decadry Fasto", and typing error correcting tapes, Tipp-Ex (trademark), available fro Kokuyo Co., Ltd. Tape type articles can be exemplified by correction tapes, WHIPER (trademark), of Plus Co., Ltd., correction tapes, Rimuka (tradename), of Nichiban Co., Ltd., and those sold by Kokuyo Co., Ltd., under the tradename of Keshipita.

Of these transferable cover-up tapes hitherto sold, those of sheet type and some of tape type (the above WHIPER from Plus Co., Ltd., Keshipita from Kokuyo Co., Ltd., etc.) comprise a transparent or translucent releasing paper having provided thereon a coating layer having an adhesive property such as a white ink and the coated surface on exposure is superposed on a predetermined adherend (for example, on the portion of a document where letters intended to correct or cover are written down) and pressed thereon to transfer the coated layer to the adherend. In this case, due to the limitation in thickness of the coated layer to be transferred as a cover-up, letters under the transferred coated layer are sometimes seen therethrough and the cover-up effect is not satisfactory. Also, when the transfer is intended to be retried or the letters covered up are planned to reveal again, the coated layer once transferred is very difficult to peel off without impairing the adherend.

The remainder of prior tape type transferable cover-up articles comprises a tape substrate having a removable adhesive applied thereon and being rolled. An example thereof is the above Rimuka from Nichiban Co., Ltd. In the case of this type of articles, the tape for cover-up is unrolled, cut into a required length, superposed on a location to be masked and pressed to effect the masking. Since the adhesive used is removable, the cover-up tape can be removed later. However, since the both ends of the cut tape must be took hold of by fingers during cover-up operation, this type of transferable cover-up articles cannot avoid being stained at the fingered portions. The stain on the side to be adhered to an adherend causes poor adhesion to the adherend, and the stain on the side exposed after adhesion to the adherend, and the stain on the side exposed after adhesion to the adherend is aesthetically not preferred, resulting in a trouble particularly when being copied. Furthermore, when adhesion operation is repeated due to the tape being not adhered to a given location, the problems accompanied with the stain increasingly become serious.

BRIEF DESCRIPTION OF THE DRAWINGS

FIG. 1(*a*) is an upper view thereof; and

FIG. 1(*b*) is a cross section of (a) cut along the I—I line.

FIG. 2(*a*) is an upper view thereof; and

FIG. 2(*b*) is a cross section of (a) cut along the II—II line.

SUMMARY OF THE INVENTION

Figure 1A:
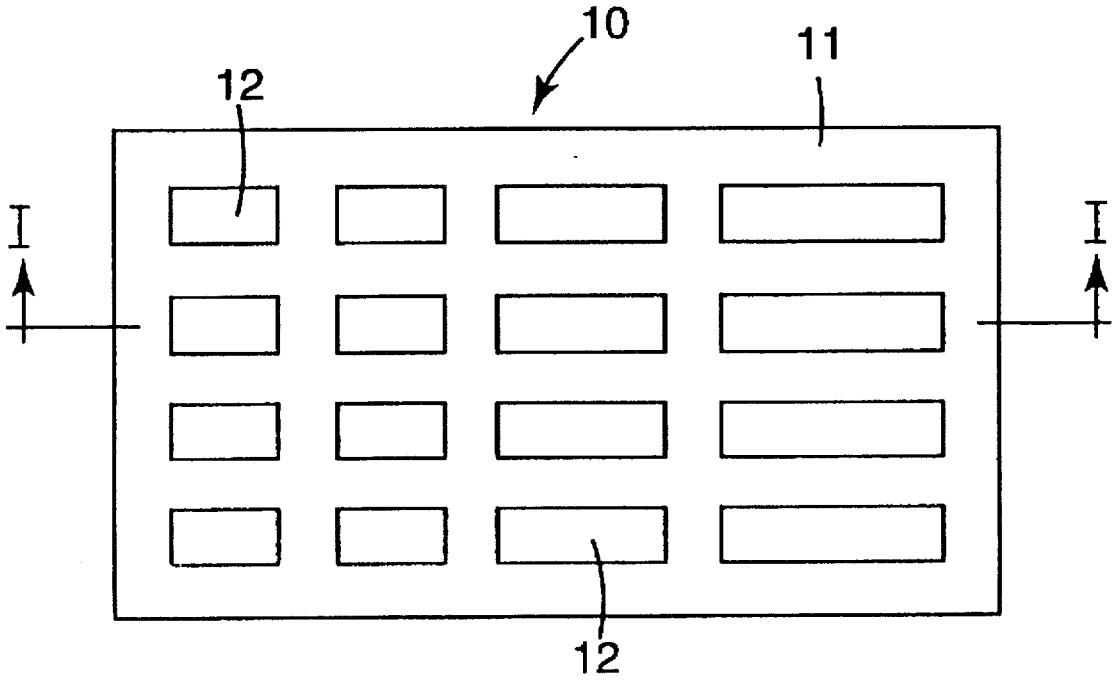
FIG. 1 is a view showing a transferable cover-up sheet as one embodiment of the present invention.

The present invention provides a new type transferable cover-up article capable of correct adhesion of the cover-up substrate to an adherend without staining a substrate, the article having sufficient cover-up force and also able to be removed.

DESCRIPTION OF THE PREFERRED EMBODIMENT(S)

The transferable cover-up article of the present invention comprises a light-transmitting backing and a cover-up substrate laminated on the backing through a removable adhesive, the substrate being smaller than the backing and a removable adhesive being laminated on the substrate surface not facing the backing.

The cover-up substrate for use in the transferable cover-up article of the present invention may be any as long as it is a tape- or sheet-form material having a sufficient masking property. The term "masking property" as used in the present invention means a function to completely or almost completely disable a person for seeing through the substrate letters, figures or characters written down or printed on an adherend. In copying a document or the like having transferred thereon a cover-up substrate, the substrate itself is preferably not copied as a shadow.

Representative examples of the substrate having such a masking property include paper materials and plastic materials. The color of the material is not particularly restricted, however, in the case where the adherend to which a cover-up substrate is transferred is a document, the cover-up substrate may be preferably white or nearly white. Examples of effective white substrates include a wood free paper having coated thereon a white pigment such as titanium white or calcium carbonate, a plastic film having mixed therein the above-described white pigment and a plastic film having coated or printed thereon the above-described white pigment. White substrate tapes or sheets conventionally used for the cover-up articles can also be used.

The thickness of the substrate is suitably from 50 to 150 μm, the covered part is contrasted, the substrate transferred to an adherend gives a feeling of foreign matter and the substrate is very likely copied into a shadow.

The backing used in the present invention must be light-transmitting to facilitate settling, through the backing, of a position where the substrate is attached under pressure on transferring the substrate to an adherend. The backing must be of course visually distinguishable from the adherend and also from the substrate. Examples of the backing for use in the present invention include transparent or light-transmitting plastic materials such as polyethylene, polypropylene, vinyl chloride and polyester. A general-purpose tape- or sheet-form backing known as an "application tape" or "application sheet" made of the above-described materials may also be used in the present invention.

The thickness of the plastic material used as the backing is suitably from 50 to 150 μm. If the thickness is less than 50 μm, the backing may be readily wrinkled on the cover-up operation to cause difficultis in correctly bonding the substrate to the cover-up part on an adherend, whereas if the thickness exceeds 150 μm, the backing can be hardly removed after adhesion of the substrate to the cover-up part.

In using the transferable cover-up article of the present invention, the article is positioned so that the substrate can be affixed to a predetermined portion of an adherend and then pressed thereon and only the backing can be removed to leave the substrate adhering to the cover-up portion. Accordingly, it is important in the present invention that the substrate is smaller than the backing. Owing to this, also, the cover-up part on the adherend can be confirmed through the light-transmitting backing at the cover-up operation. In addition, fingers can take the transferable cover-up article without coming into contact with a part of the substrate at all or so much and accordingly, the substrate can be prevented from being deteriorated in adhesion to the substrate due to the stain of the substrate, which is advantageous at need for trying again the cover-up operation.

The substrate and backing may have any shape as long as they satisfy the above-described condition that the substrate is smaller than the backing. For example, a transferable cover-up article may consist of a sheet-form backing and a plurality of substrates having independent shapes laminated on the backing. In this case, the substrates all may be in the same shape or may have different shapes. Also, a continuous or discontinuous substrate in the form of a tape may be laminated on a tape-form backing.

The removable adhesive used in the transferable cover-up article of the present invention may be any as long as the substrate only is left adhering to an adherend on peeling the backing for transferring the substrate onto the cover-up part of an adherend and in addition, the substrate can be easily peeled off when the substrate is removed from the adherend later.

The usable removable adhesives are exemploified by those known as weak self-adherent adhesives and those known as microsphere adhesives. For the materials for these adhesives, acrylic adhesives and rubber-base adhesives can be referred to. In particular, the blend has preferably a high glass transition temperature and to this effect, an acrylic acid component may be increased in proportion in the acrylic adhesive or a tackifier having a high melting point may be compounded into the rubber-base adhesive.

The removable adhesive is preferably coated to have a thickness of from 5 to 30 μm. If the thickness is less than 5 μm, the adhesive strength is lowered too much to bond the substrate to an adherend, whereas if it exceeds 30 μm, an excess of the adhesive protrudes and the substrate may not adhere to an adherend on peeling off the backing and may be removed while sticking to the backing.

In the present invention, the adhesive used for laminating the substrate on the backing and the adhesion laminated on the substrate surface which comes into contact with an adherend both are a removable adhesive. These adhesives may be the same or different in the kind. When both adhesives used are the same in the kind, the adhesive strength of the substrate to an adherend may be rendered larger than the adhesive strength of the backing to the adherend by setting the area of the substrate bonded to the adherend larger than the area of the backing bonded to the adherend, whereby the backing can be peeled off from the substrate adhering to the adherend. When different kinds of adhesives are used, they may be set, in the same way, so that the adhesive strength of the substrate to an adherend can be larger than the adhesive strength of the backing to the adherend.

In the transferable cover-up article of the present invention, a cover-up substrate having laminated on one surface thereof a removable adhesive is laminated on a light-transmitting backing larger than the substrate through a removable adhesive with the back surface of the substrate facing the backing. Owing to the light-transmitting backing larger than the substrate, the portion of an adherend where the cover-up is intended can be easily confirmed through the backing in bonding the substrate to the pertinent portion and also, the surface of the substrate which is bonded to the adherend can be prevented from staining due to treatment of the transferable article with hands in the cover-up operation. The cover-up substrate is bonded to the cover-up part of an adherend to conceal letters and the like present thereunder. Owing to the interposition of a removable adhesive between the backing and the substrate, only the backing can be removed after bonding of the substrate to an adherend and the substrate can be left adhering to the adherend. Further, owing to a removable adhesive laminated on the surface of the substrate to be bonded to an adherend, the substrate can be removed later from the adherend, if desired, to reveal the covered part and also, the adhesion to the adherend can be tried again.

The present invention will be described below in greater detail by referring to the drawings attached.

Figure 1B:
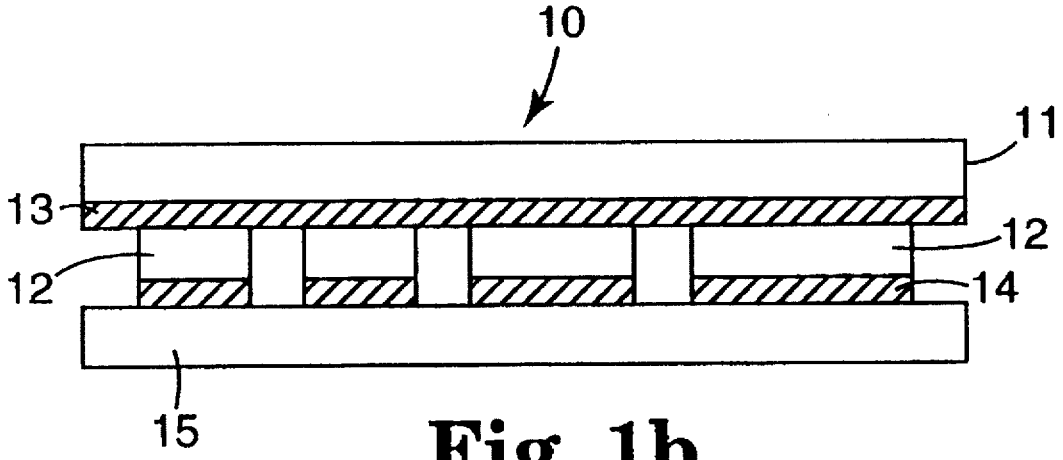

A transferable cover-up article 10 of the present invention, of which upper view is shown in FIG. 1(*a*) and cross section is shown in FIG. 1(*b*), has a constitution such that a sheet-form light-transmitting backing 11 and a plurality of tape- or sheet-form substrates 12 having a masking property are laminated through a removable adhesive layers 13 and a removable adhesive 14 is laminated on the surface of the substrate 12 on the side opposite to the light-transmitting backing 11 (on the surface which is later bonded to an adherend). An article having such a constitution can be used as a transferable cover-up sheet. As clearly seen from the cross section shown in FIG. 1(*b*), a release paper 15 treated with a release agent is further laminated on the substrate surface carrying an adhesive 14 of the transferable cover-up article 10 to protect the adhesive on the substrate. In using the transferable cover-up sheet shown in this figure, at least a part of the transferable sheets is peeled off from the release paper, a substrate in an appropriate size is bonded to a predetermined portion of an adherend, the backing is peeled off from the substrate and the transfer sheets remaining unused are superposed again on the release paper. The substrate bonded to the adherend can be removed later.

Figure 2A:
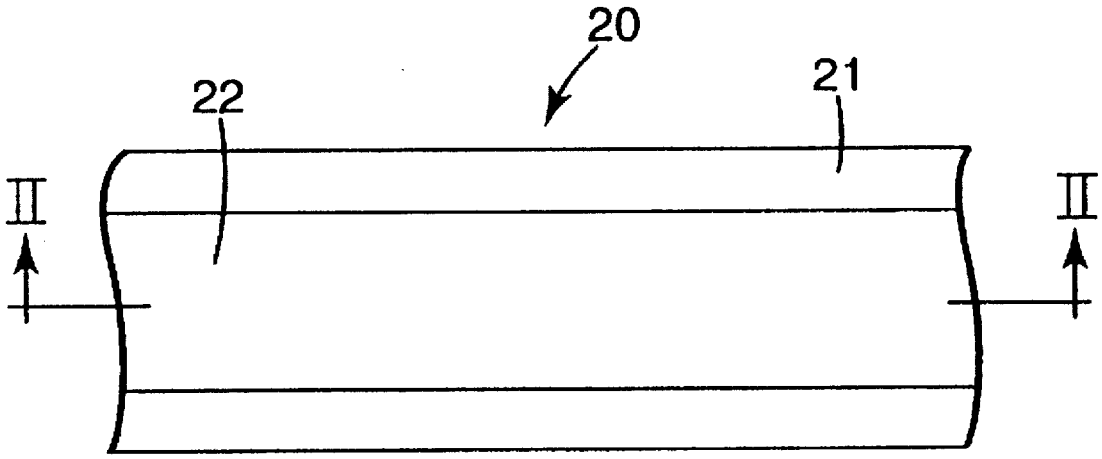
FIGS. 2(*a*) and 2(*b*) are views showing a transferable cover-up sheet as another embodiment of the present invention.
Figure 2B:
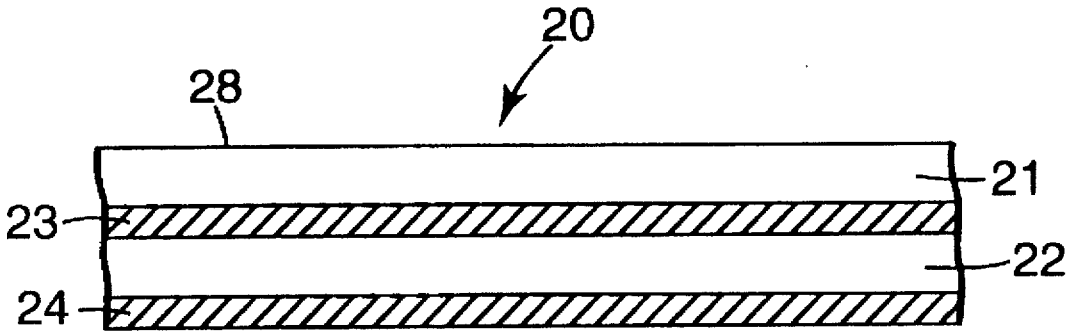

A transferable cover-up article 20 of the present invention, of which upper view is shown in FIG. 2(*a*) and cross section is shown in FIG. 2(*b*), has a constitution such that a tape-form light-transmitting backing 21 and the tape-form substrate 22 having a masking property are laminated through a removable adhesive layer 23 and a removable adhesive 24 is laminated on the surface of the substrate 22 on the side opposite to the light-transmitting backing 21 (on the surface which is later bonded to an adherend). An article having such a constitution can be used as a transferable cover-up tape. After coating a release agent on the back surface 28 of the backing 21, the tape is wound into a rolled article. In using such a transferable cover-up tape, the tape is cut off from the roll in a necessary length, the substrate is bonded to a predetermined portion of an adherend and the backing is peeled off from the substrate. The substrate adhering to the adherend can be removed later.

EXAMPLE

An acrylic adhesive (SK Dine 1495, produced by Soken Kagaku KK) is coated in an amount of 20 g/m$^2$ (coated thickness: 20 μm) on one surface of a wood free paper having a weight of 90 g/m$^2$ (thickness: 100 μm) and the paper was cut into a size of 10 mm×50 mm to prepare a pressure-sensitive adhesive sheet for use as a cover-up substrate. A pressure-sensitive adhesive tape obtained by coating the same acrylic adhesive on a transparent polypropylene film (Pylen (tradename) manufactured by Toyobo Co., Ltd.) in size of 60-μm thickness and 30-mm width in an amount of 20 g/m$^2$ (coated thickness: 20 μm) was superposed on the back surface of the pressure-sensitive adhesive sheet obtained above as a backing. Further on the back surface of the backing, a silicone-base release agent (SIL-OFF 294, produced by Dow Chemical) was coated and the coating was wound into a roll to produce a transferable cover-up tape.

On measuring the adhesive strength of the transferable cover-up tape to an adherend (copying paper) according to JIS Z 0237, the adhesive strength of the white sheet or tape (substrate) was 100 g/25 mm and that of the transparent tape (backing) was 80 g/25 mm. By using this transferable cover-up tape, the white sheet as the substrate was fitted to the portion which was intended to cover and pressed thereon and only the transparent tape was removed from the adherend, then the white sheet could be transferred to the adherend.

As described in the foregoing, the transferable cover-up article of the present invention enables a person to see an adherend by eyes through a light-transmitting backing and therefore, positioning with the portion on the adherend to be covered up can be carried out precisely and easily. This is particularly advantageous when the portion to be covered up is small.

Also, the substrate for use in the transferable cover-up article of the present invention can have an excellent masking property differently from an ink coated film and therefore, can realize a complete cover-up.

Further, the transferable cover-up article of the present invention uses a removable adhesive and therefore, the adhesion to an adherend can be tried again, the cover-up substrate can be removed from the adherend after it is through and the adherend is not wounded on peeling.

Furthermore, the transferable cover-up article of the present invention comprises a backing larger than a substrate and therefor, the adhesion to an adherend can be conducted without staining the substrate by fingers at all or so much and the substrate can be conded to the adherend without fail.

I claim:

1. A transferable cover-up article consisting essentially of a light-transmitting backing and a cover-up substrate laminated on the backing through a removable pressure sensitive adhesive, said substrate being smaller than said backing and a removable pressure sensitive adhesive being laminated on the substrate surface not facing said backing.

2. The transferable cover-up article as claimed in claim 1, wherein said light-transmitting backing is in the form of a sheet and said substrate consists of a plurality of sheet- or tape-form materials.

3. The transferable cover-up article as claimed in claim 2, wherein the substrates are the same size.

4. The transferable cover-up article as claimed in claim 2, wherein the substrates are different in size.

5. The transferable cover-up article as claimed in claim 1, wherein said light-transmitting backing is in the form of a tape and said substrate is also in the form of a tape.

6. The transferable cover-up article as claimed in claim 5, wherein said substrate is in the form of a continuous tape.

7. The transferable cover-up article as claimed in claim 5, wherein said substrate is in the form of a discontinuous tape.

8. The transferable cover-up article as claimed in any one of claims 1 to 7, wherein the adhesive strength of said substrate to an adherend is larger than the adhesive strength of said backing to the adherend.

* * * * *